US005479176A

United States Patent [19]

Zavrel, Jr.

[11] Patent Number: 5,479,176

[45] Date of Patent: Dec. 26, 1995

[54] MULTIPLE-ELEMENT DRIVEN ARRAY ANTENNA AND PHASING METHOD

[75] Inventor: Robert J. Zavrel, Jr., Scotts Valley, Calif.

[73] Assignee: Metricom, Inc., Los Gatos, Calif.

[21] Appl. No.: 327,090

[22] Filed: Oct. 21, 1994

[51] Int. Cl.[6] ..... H01Q 3/02; H01Q 3/12

[52] U.S. Cl. ..... 342/374

[58] Field of Search ..... 342/374, 434, 342/435, 403; 343/799

[56] References Cited

U.S. PATENT DOCUMENTS

| | | | |
|---|---|---|---|
| 3,725,938 | 4/1973 | Black et al. | 343/701 |
| 3,824,596 | 7/1974 | Guion et al. . | |
| 4,099,184 | 7/1978 | Rapshys | 343/875 |

*Primary Examiner*—Theodore M. Blum
*Attorney, Agent, or Firm*—Townsend and Townsend and Crew; Kenneth R. Allen

[57] ABSTRACT

An antenna array for direction-agile applications, such as r.f. packet mesh networks, employs a plurality of quarter-wave radiators disposed normally to a ground plane on a dielectric backing and switching elements for selecting a desired receiving direction and transmission direction and minimizing interference from signals in opposing directions. A control system selects and switches direction rapidly enough to receive and transmit digipeating signals in selected different directions using the phasing and switching elements. A specific embodiment employs eight radiators of 0.2625 electrical wavelengths (quarter wave plus 5%) disposed equidistant along a circle within a circular ground plane in a pattern which is ¼ wavelength from the outer boundary of the ground plane, each radiator being disposed at least 0.15 wavelengths to about 0.25 wavelengths from adjacent radiators in a circular pattern. The antenna is characterized by eight electronically switchable radiating directions (at 45° intervals) with at least 20 dB front to back ratio and a 3 dB beamwidth of 64°. Pairs of radiators form parasitic elements, driven elements and reflectors with spacing selected as a modest compromise from the ideal spacing to allow electronically selectable directionality using identically-spaced elements acting as driven elements, parasitic elements and reflector elements. The driven elements are slightly reactively fed.

13 Claims, 7 Drawing Sheets

MULTIPLE-ELEMENT DRIVEN ARRAY ANTENNA AND PHASING METHOD

BACKGROUND OF THE INVENTION

This invention relates to antennas and more particularly to directional driven-array antennas for use in fast switching directional antennas.

In a radio frequency wireless mesh network for conveying packets, there is a need to maximize network capacity. Current mesh network systems employ single element omni-directional antennas which can receive and transmit packets on a single frequency in several directions in quick succession. However, the simplicity of single element antennas does not allow for directional gain or reduction of contention and interference from undesired packets in selected directions. Multiple directional antennas would be required to overcome such problems, but, multiple directional antennas are inherently limited to specific directions and are by comparison with single antennas, unacceptably expensive to implement. What is needed is a direction-agile gain antenna system which is relatively low cost and easy to implement.

SUMMARY OF THE INVENTION

According to the invention, an antenna array for direction-agile applications, such as r.f. packet mesh networks, employs a plurality of at least six quarter-wave radiators disposed in a circle and normal to a ground plane with switching elements for selecting a desired receiving direction and transmission direction and for minimizing interference from interfering signals in other directions. A control system selects and switches direction rapidly enough to receive and transmit digipeating signals in selected different directions using the phasing and switching elements. A specific embodiment employs eight radiators of 0.2625 electrical wavelengths (quarter wave plus 5%) disposed equidistant along a circle within a circular ground plane in a pattern which is up to ¼ wavelength from the outer boundary of the ground plane, each radiator being disposed at least 0.15 wavelengths to about 0.25 wavelengths from adjacent radiators in a circular pattern. The antenna is characterized by eight electronically switchable radiating directions (at 45° intervals) with at least 20 dB front to back ratio and a 3 dB beamwidth of about 64°. In a parasitic configuration, radiators form parasitic elements and driven elements with spacing selected as a modest compromise from the ideal spacing to allow electronically selectable directionality using identically-spaced elements acting as driven elements and parasitic elements. In a phased array configuration, the radiators are fed in preselected in-phase and quadrature-phase relationships. The driven elements in either the parasitic configuration or in the phased array configuration are slightly longer than for self resonance, in one case (phased array) to raise characteristic feedpoint impedance and in the other case (parasitic) to simplify design.

An antenna system of this design has many applications. The system provides a direction-agile antenna for personal communication services, wireless wide area networks, wireless local area networks, cellular networks, public safety radio, amateur radio, commercial broadcasting and other applications. A typical size for applications and other similar services at about 800 MHz to 1.2 GHz is about 10 cm high by 30 cm in diameter. The antenna can be mounted under a weatherproof shell. Size is scaled appropriate to the operating frequency.

An eight-radiator antenna provides eight uni-directional radiation patterns with high forward gain (>13 dBi), high front-to-back ratio (about 20 dB) with small nulls (<2 dB). The directions are switchable at very high speeds using analog electronic switches. (The switching speed is under about 5 microseconds using electronic switches such as PIN diodes or GaAs switches and 10–100 milliseconds using mechanical switches). There is very low matching complexity (simple LC network), a very low passive components count (16 PIN diodes and associated de-coupling components) and it can use low-cost material: In the UHF range, the device can be constructed of a PCB board ground plane disk with eight antenna elements consisting of inexpensive ¼ wavelengths of solid copper wire.

In any particular configuration, a fraction of the radiators is operational. Four and six of the eight radiators may be activated at any one time.

The invention will be better understood upon reference to the following detailed description in connection with the listed drawings.

DESCRIPTION OF SPECIFIC EMBODIMENTS

Figure 1:
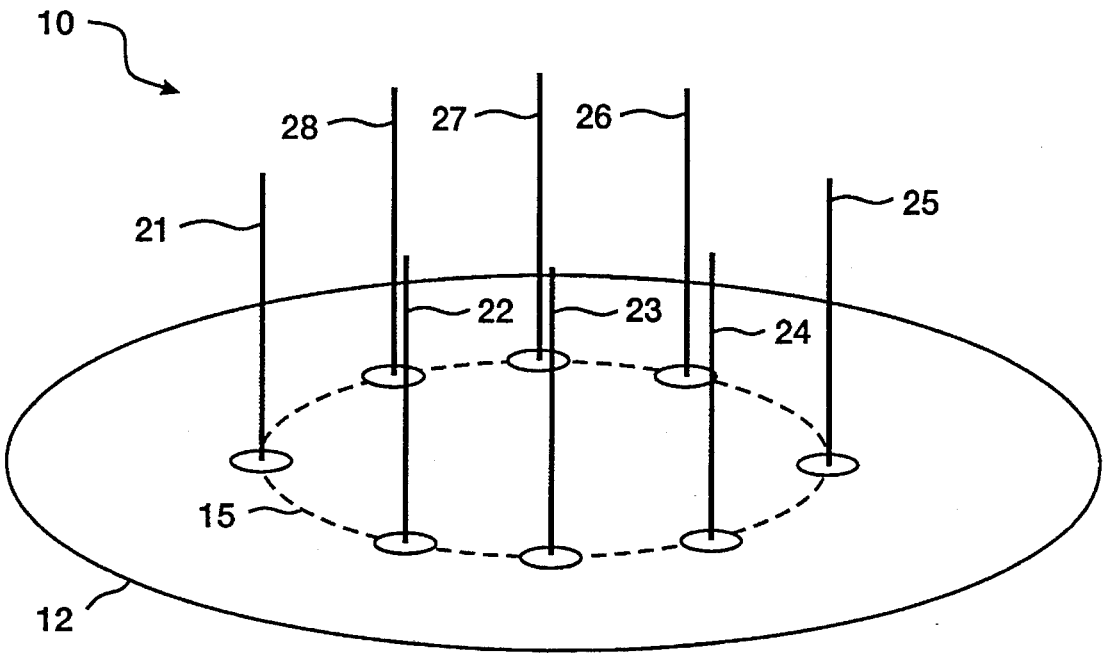
FIG. 1 is a perspective view of an antenna according to the invention.
Figure 2:
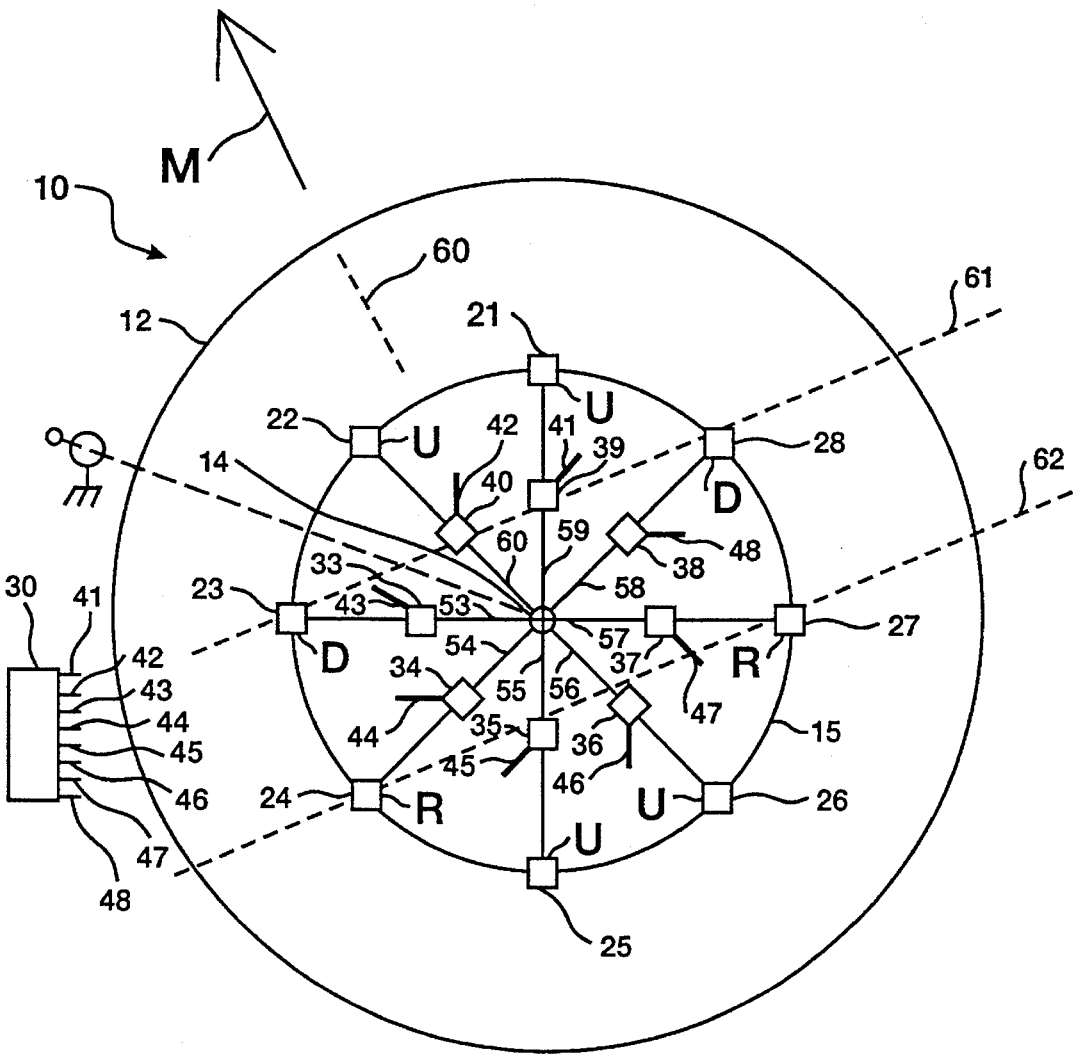
FIG. 2 is a diagrammatic top plan view an antenna configuration according to the invention showing a first pattern of active and unused radiating elements, as well as representations of signal switching elements, excited as a parasitic array.

The structure of an antenna system 10 according to the invention is shown in FIG. 1. It comprises a ground plane element 12 with a plurality of perpendicular radiators 21–28 mounted above the electric ground plane. Eight radiators 21– 28 of 0.2625 electrical wavelengths (quarter wave plus 5%) are disposed equidistant along a circle within a circular ground plane in a pattern which is ¼ wavelength from the outer boundary of the ground plane, each radiator 21–28 being disposed at least 0.15 wavelengths to about 0.25 wavelengths from adjacent radiators in a circular pattern 15. Referring to FIG. 2, in a parasitic configuration, radiators 21–28 form selectively parasitic elements R, driven elements D and unused elements U with spacing selected as a modest compromise from the ideal spacing to allow electronically selectable directionality using identically-spaced elements acting as driven elements D, parasitic elements R and unused elements U. The parasitic elements R serve a reflectors. Electronic switches 31–38 are built into or mounted under or adjacent below the ground plane 12 in feedlines 51–58 to a common feed point 14. The switches 41–48 can be a single unit mounted at the feedpoint, like a rotary switch, or they can be separate units mounted at the base of each element R, D, U. The switches 31–38 are operated through control lines 41–48 coupled to a suitable control system 30, which is operative to select and switch the switching elements 31–38 to set radiation pattern direction. Switching may be performed rapidly enough to receive and transmit digipeating signals in selected different directions using the switching elements 31–38 with no moving parts. A parasitic antenna feed point 14 to an input 16 is common to all distribution feedlines 51–58 in a parasitic antenna. The switches 31–38 provide signal blocking and routing of three states as referenced to the antenna element feedpoints at the base of each radiator 21–28: 1) shorted to ground, 2) "driven" (connection from radio signal input or output through the switch to load or match the radiator with no reflection), and 3) open ("unused"). The switches may be implemented in a number of conventional ways to realize a single-pole, triple-throw effect.

The switching speed is under about five microseconds using electronic switches such as PIN diodes or GaAs switches and 10–100 milliseconds using mechanical switches. There is very low matching complexity built into the switches 21–28, namely, a simple LC network. Only 16 PIN diodes are required to construct the network, along with associated de-coupling components. In special cases, a transmission line feed may be substituted for an LC matching network.

A. The Four-Element Parasitic Array

The optimum excitation configuration for UHF applications is the four-element parasitic array (FIG. 2). The radiator element length is slightly longer than a resonant ¼ wavelength. Two radiator elements D 23, 28 spaced circumferentially at approximately 135° apart (determined by element spacing and geometry of the circle 15) relative to the common center point 14 are selected by either mechanical or electronic switches, and they are driven in-phase. Two adjacent radiator elements R 24, 27 are simultaneously chosen, also approximately 135° apart, and their base feedpoints are effectively shorted to ground using either mechanical or electronic switches. (An open circuit in a switch 31–38 separated by one-quarter wavelength electrical distance along a feed line 51–58 from a radiator feedpoint appears as a short circuit between the radiator 21–28 and the ground plane 12.) By shorting the feedpoints to ground, the two radiating elements R 24–27 become parasitic elements to the driven elements. Because they are slightly longer than ¼ wavelength, they serve as reflector elements. The feedpoints of four unused elements U 21, 22, 25, 26 are set as switched "open" relative to the feedpoints by means of a high impedance formed among ground, the feedpoint, and the antenna feedline by using mechanical or electronic switches. This coupling effectively removes these elements U from the array in that they have minimal parasitic effects on the resulting pattern. The maximum response is in the direction of the driven element along a line M bisecting the line 61 through the feedpoints of the two driven elements D as well as a line 62 through the feedpoints of the associated parasitic reflector elements R. The two lines 61, 62 formed by the set of driven-reflector elements are parallel, With 0.2 wavelength spacing between the elements D and R, the lateral spacing between the two pairs DR, DR is about 0.45 wavelengths. The result is two vertical two-element beam antennas operating in a broadside configuration.

There are eight possible combinations of this particular array configuration. The resulting eight patterns are identical but displaced in increments of 45°, thus providing full 360° coverage. The 3 dB beamwidth is about 66° providing near-optimum null-filling overlap to the patterns. The 22.5° nulls are only about 2 dB.

Parasitic element spacing of 0.2 wavelength is convenient because the resulting VSWR on the line approaches 2:1. By judicious choice of 50 ohm feedline lengths, a 2:1 SWR can yield a purely resistive 100 ohm feedpoint. Connecting the two 100 ohm feeds from the two driven elements results in a purely resistive 50 ohm feedpoint near or aligned with the center of the ground plane 12. Consequently, no further impedance matching is required for this special case.

However, it might be desirable to use ¾ wavelength feedlines to each element. With such a configuration no switches are even required at the element feedpoints. As a trade-off, a complex impedance will appear at the parallel feedpoint. This will require an LC network for matching. The choice will be determined by the specific application and operating frequency of the array.

Figure 3:
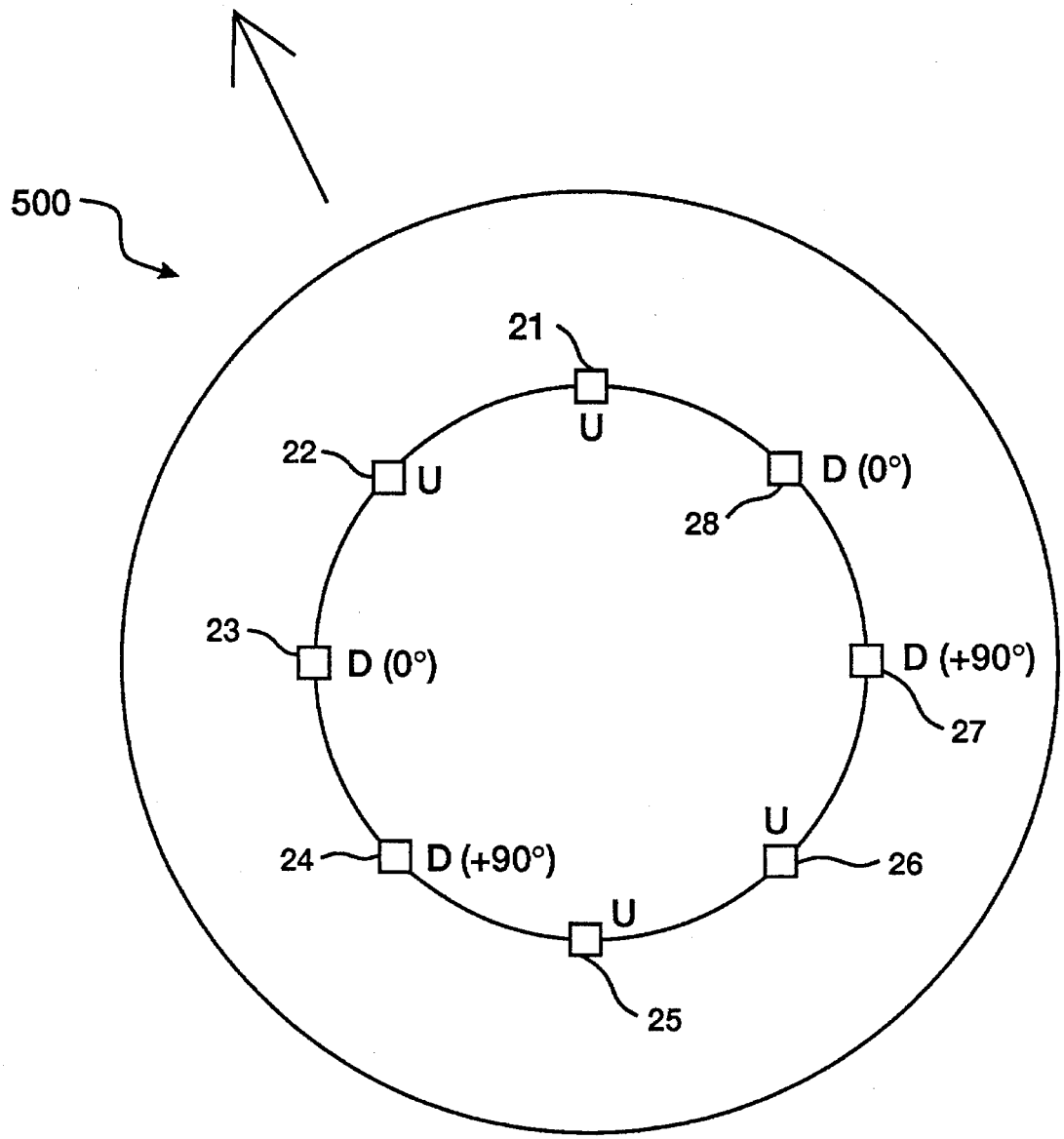
FIG. 3 is a diagrammatic top plan view an antenna configuration according to the invention showing a second pattern of active and unused radiating elements excited as a phased array.
Figure 4:
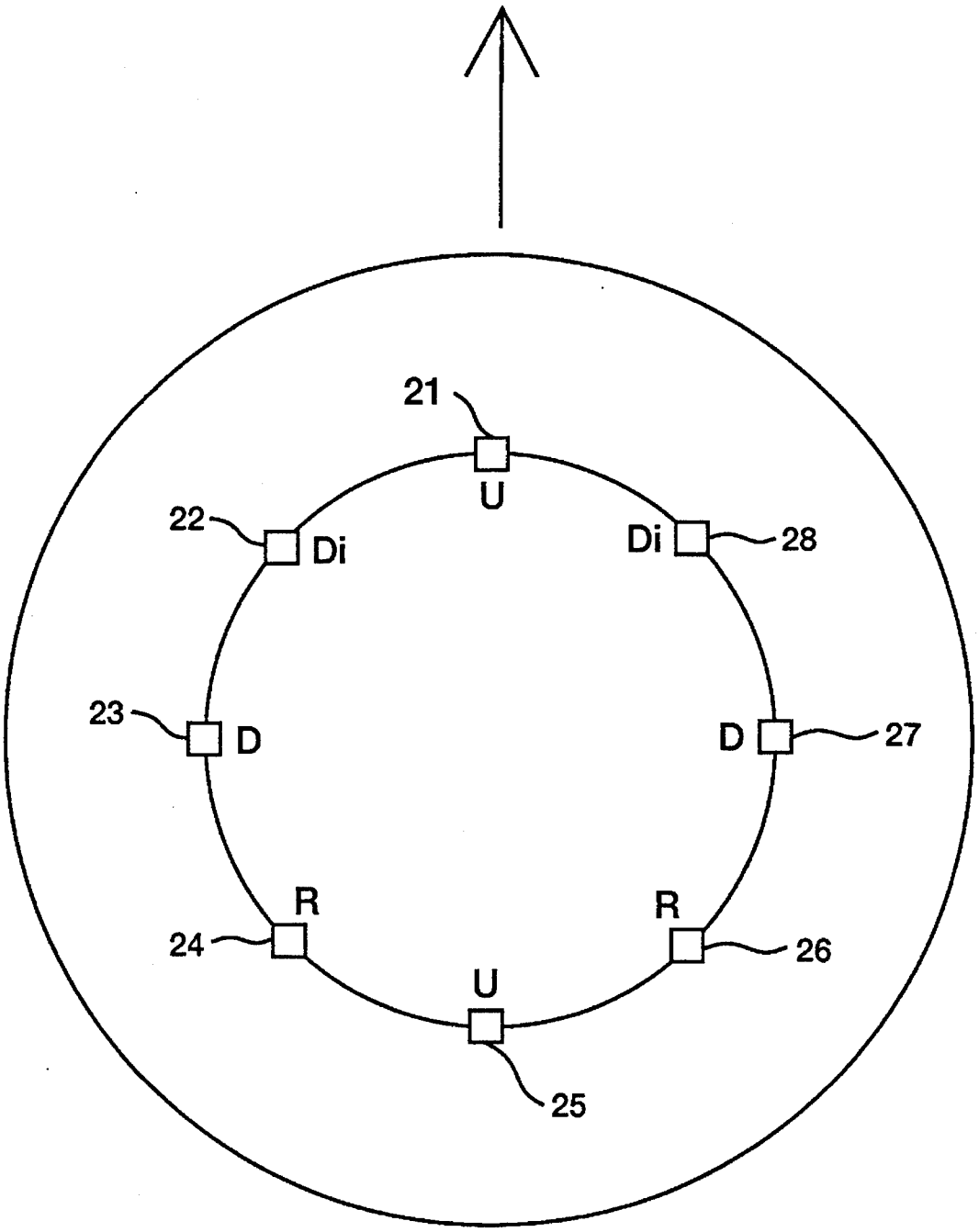
FIG. 4 is a diagrammatic top plan view an antenna configuration according to the invention showing a third pattern of active and unused radiating elements excited as a parasitic array.
Figure 5:
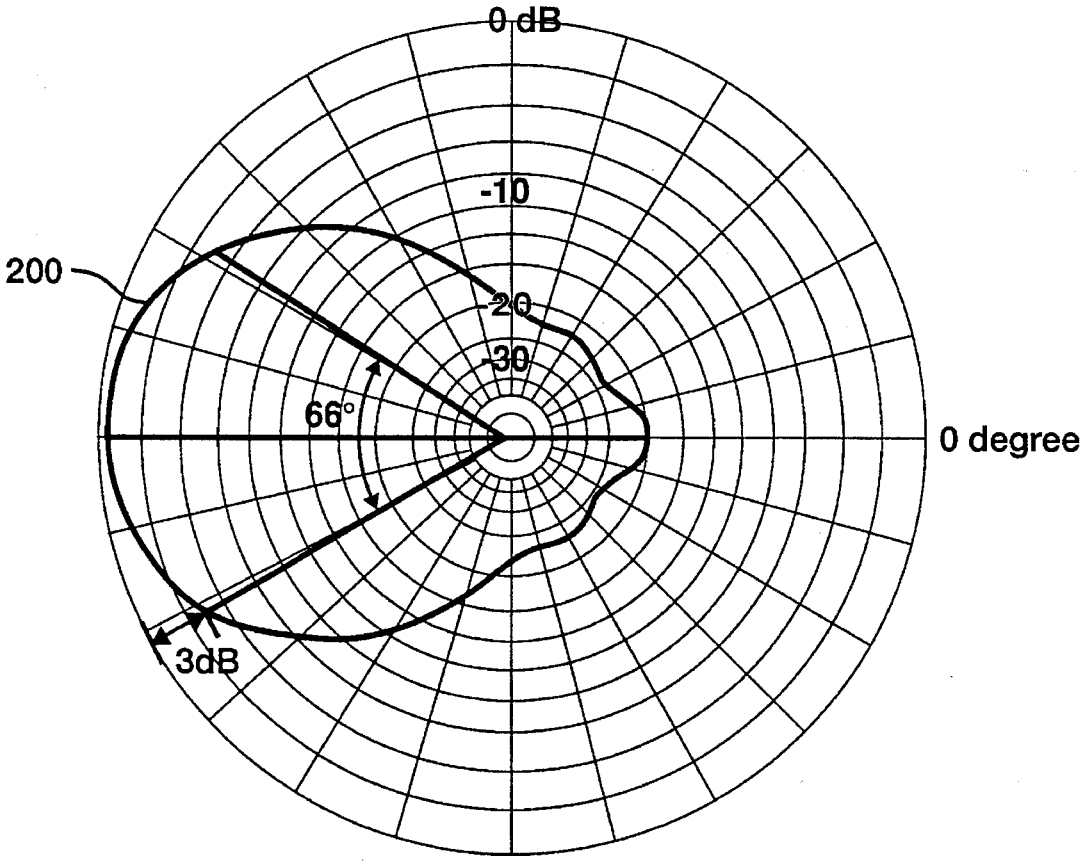
FIGS. 5, 6 and 7 show computer simulations of azimuth patterns and feedpoint impedance calculations for parasitic and phased array antenna configurations.
Figure 6:
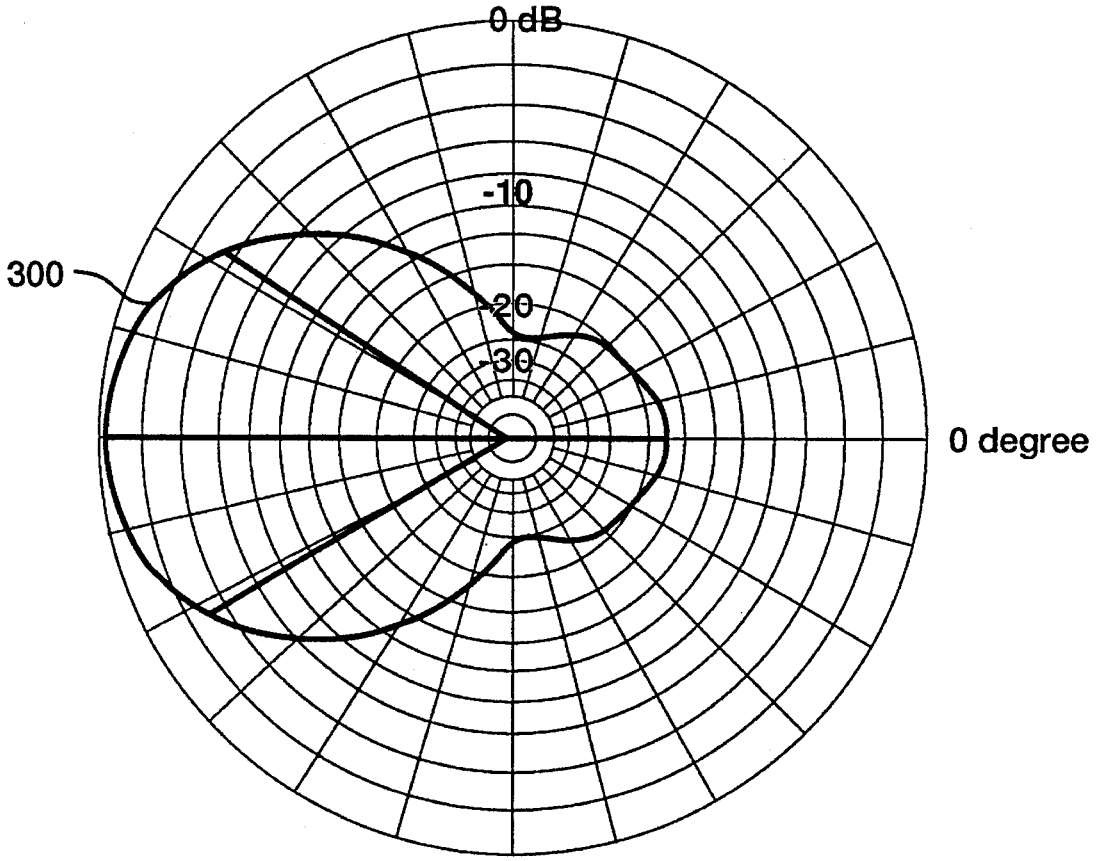
Figure 7:
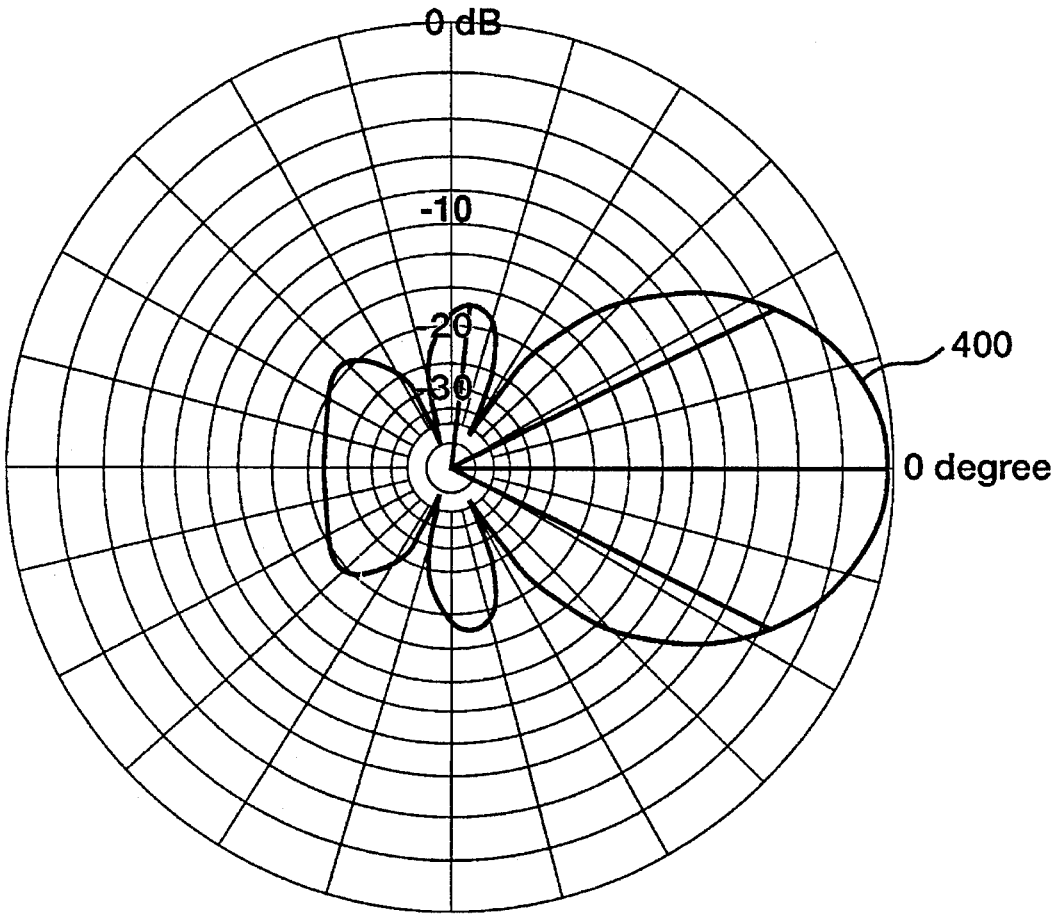

FIGS. 5, 6 and 7 show computer simulations of patterns and feedpoint impedance calculations from ELNEC™ software. These plots are included for the frequencies of the 902–928 MHz ISM band. FIG. 5 illustrates an azimuth radiating pattern 200 for a multi-element parasitic-type radiator of the type shown in FIG. 4 as plotted for 902 MHz with an elevation angle of 5.0°. FIG. 6 illustrates a comparable azimuth radiating pattern 300 for an eight element parasitic-type radiator of the type shown in FIG. 4 as plotted for 928 MHz with an elevation angle of 5.0°. FIG. 7 illustrates an azimuth radiating pattern 400 for a multi-element phased-array-type radiator of the type shown in FIG. 3 as plotted for 902 MHz with an elevation angle of 5.0° and as explained below.

B. The Four Element Phased Array

A four element phased array 10 (FIG. 3) is similar in all respects to the four element parasitic array with the following exceptions:

1) While the same two pairs of elements 23, 28; 24, 27 are active, rather than shorting two to ground to form parasitic elements, four elements are driven.
2) The first two elements 23, 28 are fed 90 degrees in advance of the second two driven elements 24, 27.
3) A pattern very similar to a parasitic array pattern results, except the phased array shows a very slight advantage over the parasitic array in forward gain.

The four-element phased array has the disadvantage that a 90 degree phase network is required and the feedpoint impedances can be quite low (less than 3 ohms). The elements are cut slightly longer as in the four-element parasitic array but for a different reason, namely, to raise the feedpoint impedance. The spacing is 0.25 wavelengths creating the need for a larger ground plane. However, this increased length also increases the spacing between the two element beams to about 0.6 wavelengths, near optimum for maximizing forward gain. FIG. 7 shows the radiation pattern of this configuration.

C. Six-Element Parasitic Array

A six-element parasitic array (based on FIG. 2) uses two three element beams set along the opposite sides of the circle. (Two elements are not used or are removed, and the spacing may be equalized.) This configuration creates two vertical beams with, in effect, a boom which is bent into a semi-circle. Unlike the four- and eight-element arrays, the two driven elements (e.g., 23, 27) are directly opposite across the circle. The two reflectors are configured with adjacent elements in the same direction from the driven elements, and two directors are configured with adjacent elements in the opposite direction. Despite the "bent" beam configuration, the pattern shows a comparable pattern to the four-element parasitic array, except for a slightly higher forward gain (about 14 dBi). In this configuration, all elements are cut to ¼ wave resonance. A small inductor may be switched in at the feedpoints of the reflectors and small capacitive reactance is switched in at the feedpoints of the director elements. The two driven elements are fed in-phase.

The added complexity of switching and matching creates some disadvantage. However, at all times 75% of the available elements are used to good advantage compared to 50% in the other two configurations.

The invention has now been explained with reference to specific embodiments. Other embodiments will be apparent to those of skill in the art. It is therefore not intended that this invention be limited, except as indicated by the appended claims.

What is claimed is:

1. A multiple-element array antenna system comprising:

a conductive ground plane base having an outer boundary;

eight equal-length radiating elements of at least one-quarter wavelength electrical length at a selected operating frequency, each said radiating element being disposed with a first end adjacent said ground plane and a second end protruding normal to said ground plane, each said radiating element being arranged equidistant along on a circle within said conductive ground plane, said circle being disposed at least one quarter wavelength from said outer boundary in an equally space pattern, wherein two of said radiating elements are selectable as type 1 elements and two of said radiating elements are selectable as type 2 elements, while unused elements are effectively electrically isolated, wherein said two type 1 elements are driven elements and are spaced from one another by three element positions in one circular direction and five element positions in the opposing circular direction on said circle, wherein said two type 2 are spaced from one another by three element positions in one circular direction and five element positions in the opposing circular direction on said circle, and wherein each said driven element is spaced by one element position from one of said type 2 elements;

a plurality of feed means, each said feed means being electrically coupled to corresponding element feedpoints at said first ends; and switching means for gating r.f. energy to selected ones of said feed means;

said pattern of said radiating elements and said switching means governing a preselected switchable radiating pattern having a maximized front-to-back ratio.

2. The antenna system according to claim 1 wherein said type 2 elements are reflector elements.

3. The antenna system according to claim 2 wherein said radiating elements are of length which is slightly greater than one quarter of an electrical wavelength of said radiators.

4. The antenna system according to claim 3 wherein said antenna is a parasitic array configuration, wherein said type 2 elements are reflector elements and wherein length of said radiating elements is chosen as an optimum for said reflector elements.

5. The antenna system according to claim 3 wherein said antenna system is a phased array configuration, wherein said type 2 elements are also driven elements, said type 2 driven elements being restrained to be driven in quadrature phase to said type 1 driven elements

6. The antenna system according to claim 1 wherein said switching means comprises a set of electronic switches.

7. The antenna system according to claim 1 wherein said switching means comprises a set of mechanical switches.

8. The antenna system according to claim 1 wherein said antenna is a parasitic configuration and wherein said switching means is configured to select electrical connection at a base of each radiating elements between a feed for a driven element function, a short-to-ground for a reflector element function and an open circuit for unused function.

9. The antenna system according to claim 8 wherein said feed means includes a transmission line segment, said transmission line segment matching said driven elements with a central feedpoint.

10. The antenna system according to claim 1 wherein said antenna is a phased array configuration and wherein said switching means is configured to select electrical connection at a base of each radiating elements between a zero-degree phase input feed, a ninety-degree phase input feed and an open circuit for a non-operational function.

11. A method for receiving and transmitting r.f. energy using a multiple-element array antenna system, said antenna system comprising a conductive ground plane base having an outer boundary;

eight equal-length radiating elements of at least one-quarter wavelength electrical length at a selected operating frequency, each said radiating element being disposed with a first end adjacent said ground plane and a second end protruding normal to said ground plane, each said radiating elements being arranged equidistant along on a circle within said conductive ground plane, said circle being disposed at least one quarter wavelength from said outer boundary in an equally spaced pattern, wherein two of said radiating elements are selectable as type 1 elements and two of said radiating elements are selectable as type 2 elements, while unused elements are effectively electrically isolated, wherein said two type 1 elements are driven elements and are spaced from one another by three element positions in one circular direction and five element positions in the opposing circular direction on said circle, wherein said two type 2 are spaced from one another by three element positions in one circular direction and five element positions in the opposing circular direction on said circle, and wherein each said driven element is spaced by one element position from one of said type 2 elements;

a plurality of feed means, each said feed means being electrically coupled to corresponding element feedpoints at said first ends; and switching means for gating r.f. energy to selected ones of said feed means;

said pattern of said radiating elements and said switching means governing a preselected switchable radiating pattern having a maximized front-to-back ratio, said method comprising:

activating first pairs of switching means to establish directionality of a first direction for said antenna array;

receiving an r.f. signal from said first direction; thereafter activating second pairs of switching means while deactivating said first pairs to establish directionality of a second direction; and transmitting a representation of said r.f. signal in said second direction.

12. The method according to claim 11 wherein said activating steps comprise establishing parasitic configurations.

13. The method according to claim 11 wherein said activating steps comprise establishing phased array configurations.

* * * * *